US005551662A

United States Patent [19]

Keady

[11] Patent Number: 5,551,662

[45] Date of Patent: Sep. 3, 1996

[54] STONE POST GUIDE SYSTEM

[76] Inventor: Paul A. Keady, P.O. Box 242, Schurz, Nev. 89427

[21] Appl. No.: 543,927

[22] Filed: Oct. 17, 1995

[51] Int. Cl.[6] ..... E04G 13/02

[52] U.S. Cl. ..... 249/51; 249/48; 249/93

[58] Field of Search ..... 249/510, 48, 143, 249/92, 207

[56] References Cited

U.S. PATENT DOCUMENTS

| | | | |
|---|---|---|---|
| 4,047,356 | 9/1977 | DePirro | 249/48 X |
| 4,749,165 | 6/1988 | Moraca | 249/48 |
| 4,790,509 | 12/1988 | Cardwell et al. | 249/51 X |
| 5,368,269 | 11/1994 | Boisseau | 249/48 X |

FOREIGN PATENT DOCUMENTS

| | | | |
|---|---|---|---|
| 2676772 | 11/1992 | France | 249/51 |

*Primary Examiner*—Carl D. Friedman
*Assistant Examiner*—Yvonne Horton-Richardson
*Attorney, Agent, or Firm*—Joseph H. McGlynn

[57] ABSTRACT

A jig having top and bottom collar with the top collar being either smaller than the bottom collar or the same size. The collars are joined by four stakes welded to the bottom collar which are used to level the jig. A third collar, called a centering collar, is attached to the top collar and has a pipe attached to it which extends down into the center of the jig to suspend a second pipe in the exact center of the jig. The centering collar and pipe have a lifting eye attached thereto, so a crane can lift the jig and completed stone post and move it to a new location. The stakes of the jig can be used as a guide to plumb and level stone which can be laid to form a stone post.

7 Claims, 2 Drawing Sheets

STONE POST GUIDE SYSTEM

BACKGROUND OF THE INVENTION

This invention relates in general to making stone posts and in particular to a guide for use by a stone mason to build a stone post.

Due to the labor intensive nature of laying stone, more and more architects and builders are forsaking stone for a cheaper, faster way to dress up homes and commercial buildings. Often they resort to using artificial stone or eliminating stone altogether. Also, home owners who would like to do their own stone work lack the necessary skills to lay stone. What is needed is to make laying stones less labor and skill intensive so stone work would be commercially feasible and available to the average home owner.

DESCRIPTION OF THE PRIOR ART

In the prior art various types of systems for producing posts or columns have been devised. For example, U.S. Pat. No. 838,592 discloses a concrete fence post with internal reinforcing members and an outer strengthening member of steel wire. U.S. Pat. No. 1,804,320 discloses a tubular fabricated decorative column which encloses and conceals the usual structural steel column. U.S. Pat. No. 2,143,616 discloses a concrete column made from U-shaper and L-shaped blocks. U.S. Pat. No. 3,245,190 discloses a concrete column with a metallic reinforcing structure.

SUMMARY OF THE INVENTION

The present invention consists of a jig having a top and bottom collar with the top collar being smaller than the bottom collar or the same size. The collars are joined by four stakes welded to the bottom collar which are used to level the jig. A third collar, called a centering collar, is slipped over the top collar and has a center steel rod or pipe which is held in place by the centering collar and which extends down into the center of the jig. The center pipe is threaded for two purposes: first, it is the receiver for the threaded collar; second, it is the receiver for the lifting eye by which a crane can lift and transport the completed post.

It is an object of the present invention to provide a new and improved jig for making stone posts.

It is an object of the present invention to provide a new and improved jig for making stone posts that reduces the amount of labor necessary to produce such a post.

It is an object of the present invention to provide a new and improved jig for making stone posts that reduces the amount of skill necessary to produce such a post.

These and other objects and advantages of the present invention will be fully apparent from the following description, when taken in connection with the annexed drawings.

DESCRIPTION OF THE PREFERRED EMBODIMENT

Figure 1:
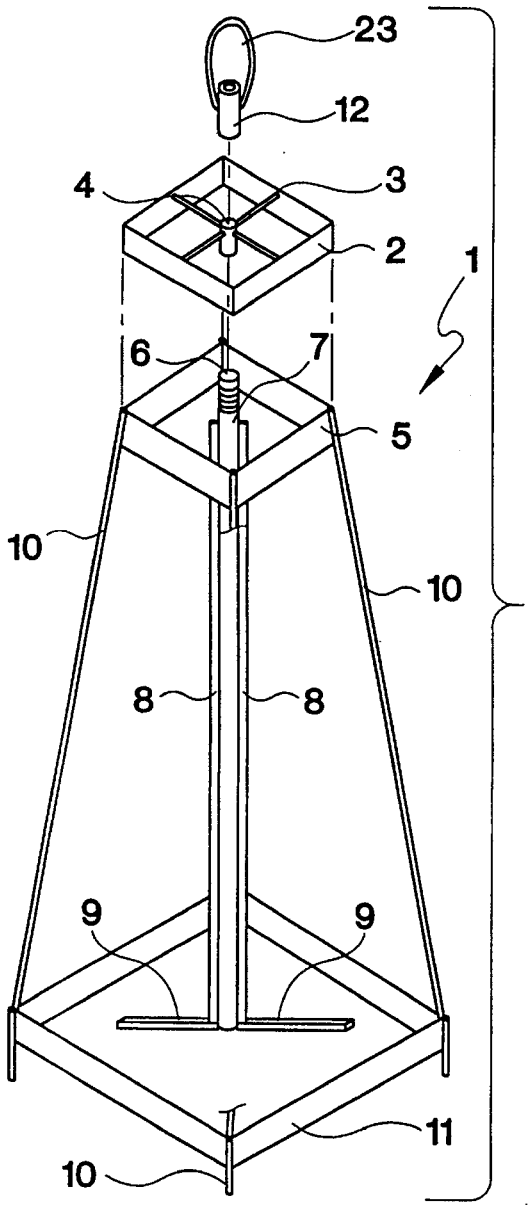
FIG. 1 is a perspective view of the present invention.

Referring now to the drawings in greater detail, FIG. 1 shows an exploded perspective view of the jig 1 of the present invention. It consists of an upper collar 5 connected to a lower collar 11 by four legs 10. The legs 10 could be reinforcing bars or could be made out of any type of metal which will perform the intended function. In the case of a stone post which is designed to be built in place (on the site where the post will be placed and where it will remain) the legs 10 will extend beyond the lower collar 11 so they can be inserted into the ground beneath the jig 1. This will allow the extended legs to be hammered into the ground in order to level the jig. The length of legs 10 below lower collar 11, as shown in FIG. 1, is for illustration purposes only. The legs can be of any length so they can be inserted into the ground to level the jig 1.

Figure 2:
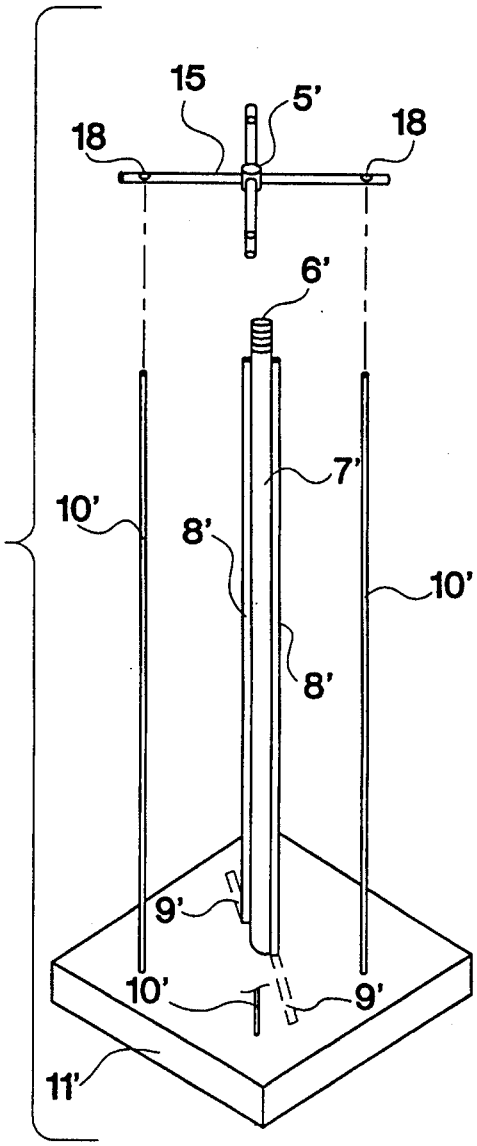
FIG. 2 is a second embodiment of the present invention.

If the stone post will be constructed at one location and then moved to another location, the jig shown in FIG. 2 could be used, or a jig similar to the jig of FIG. 1 could be used without the extended legs. The jig could be set up on a precast concrete slab, which would be used only during the construction of the stone post as a flat working surface. After the post is finished, the concrete slab would not be needed.

Inserted into the center of the jig of FIG. 1 will be a pipe 7 attached to which such as by, but not limited to, welding will be a pair of bars 8, which could be reinforcing bars (known as rebars). The bottom of the bars 8 will be bent outward as shown at 9 so the bottom of the bars will be embedded in the concrete when it is poured into the jig, as will be explained below. Attached to the top of the pipe 7 is a nipple having an externally threaded end 6. As an alternative the top of the pipe 7 could be threaded.

At the top of the jig, as shown in FIG. 1, is a centering collar 2 having support bars 3, which suspend a cylinder 4. The cylinder 4 will not be threaded but will slip over the externally threaded end of nipple 6. The centering collar 2 is slightly larger than the upper collar 5 and the cylinder 4 is fixed exactly in the center by means of bars 3. The cylinder 4 will fit unto the top of pipe 7 when the centering collar is placed on the upper collar 5. The centering collar 2 will rest on the upper collar 5 so the entire jig can be leveled and the pipe 7 will be positioned by the centering collar at the center of the jig 1. The pipe 7 can be used to pass electrical wires through the concrete after it is poured into the jig, in order to position a lamp on the top of the finished post.

After the stone has been laid and the post is complete, the centering collar 2 is manually removed. Then the jig is manually lifted off the stone post. As soon as the stonework has cured sufficiently, the lifting eye 12 is screwed onto the threaded nipple 6 of the center steel and/or pipe 7. Finally, the crane can hook into the lifting eye at 23 in order to transport the completed stone post.

In FIG. 2 a second embodiment of the present invention is shown. The method of using the jig of FIG. 2 starts with the jig of FIG. 1 without the extended legs, i.e. the portion of the legs 10 which extend below collar 11. First the jig 1, pipe 7' and reinforcing bars 8', and centering collar 2 are set into place and leveled and concrete is poured into the bottom collar 11 and allowed to set for several hours until it is partially cured as pad 11'. Then the jig 1 can be manually lifted off leaving pipe 7' and reinforcing bars 8' embedded in the pad 11'. Next internally threaded collar 5' is screwed onto the nipple 6' of pipe 7'. Guide stakes 10', which can be reinforcing bars, are placed in apertures 15 down to the concrete base that has been recently poured. The guide stakes 10' are shown in FIG. 2 as attached to the pad 11' merely for illustration purposes to show the final position of the guide stakes. The rebars or guide stakes 10' are plumbed and aligned and pushed gently into the partially cured concrete base to maintain temporary stability as corner guides. The height of the post will be determined by the height of the center pipe 7' and can be adjusted as necessary by using different sizes of pipes. At this point the stone can be laid, using the guide stakes 10', to plumb and level the stone as it is being laid.

Figure 3:
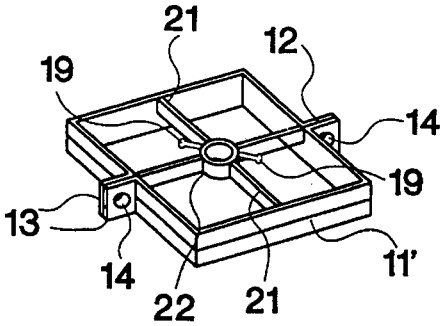
FIG. 3 is a view of a collar used with the present invention.
Figure 7:
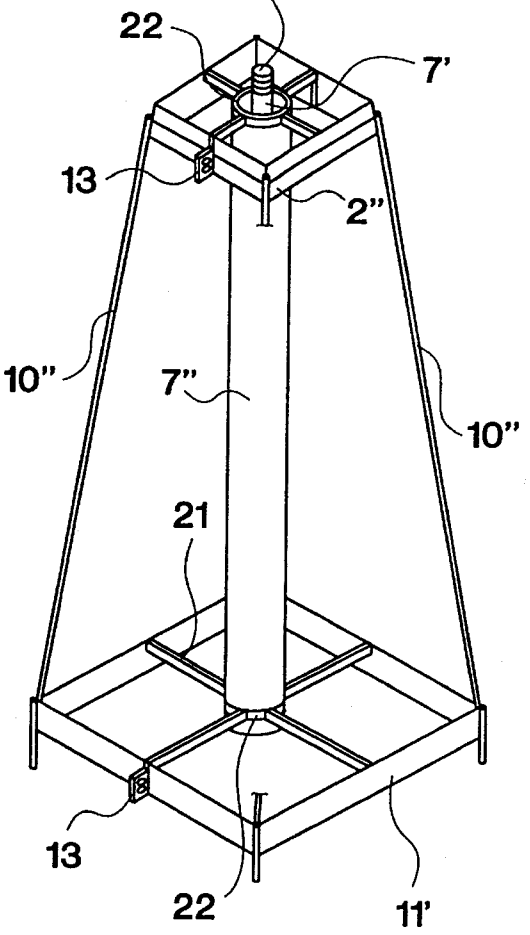
FIG. 7 is a perspective view of the jig using the collars of FIG. 3.

In FIG. 3 a different type of collar 11' is shown. It should be noted that the collar shown in FIG. 3 could be used for both the upper and lower collars. The collars can be the same size if a rectangular post is desired, or they can be of different sizes if a tapered post is desired. This is true of all the jigs shown in the drawing figures. The collar 11' has a split at 12 on each side, which will make it easier to remove the collar after the concrete is poured into the jig. The collar has a pair of flanges 13 attached to, or unitary, with the collar at the splits and an aperture 14 which can receive a bolt with a nut (not shown) to hold the split collar together. Bars 21, similar to bars 3 in the FIG. 1 jig are attached to a center pipe 22 which is similar to pipe 4. Set screws 19 extend through 22 to secure cylinder 7" (shown in FIG. 7).

It should be noted that the jig shown in FIG. 1 is tapered with the upper collar 5 being smaller than the lower collar, however this shape is for illustration purposes only. The shape of the jig can be rectangular or circular, or any shape desired without departing from the scope of the invention.

Figure 4:
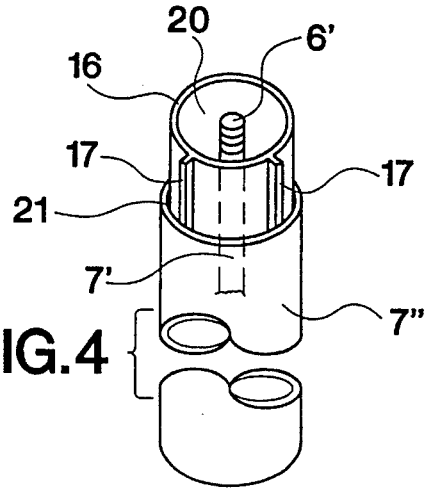
FIG. 4 is view showing the cylinders used to make a stone post..

The process of using the device shown In FIG. 4 begins exactly the same as the process used for the FIG. 2 device up to the point where the concrete has set for several hours. This time the jig 1 is not removed, but the centering collar 2 is removed and replaced with the collar shown in FIG. 3. It is essentially the same as collar 2 except the pipe 22 has a greater diameter than 4 to accommodate cylinder 7". In order to stabilize the lower portion of cylinder 7", a split bottom collar 11' (shown in FIGS. 3 and 7) is placed on the concrete pad. Now cylinder 7" is dropped through the center of the structure, passing over pipe 7' and reinforcing bars 8' (not shown in FIG. 7), and set screws 19 are placed through the larger collar 22 to hold cylinder 7". Now cylinder 16, (see FIG. 4) which has ridges 17 around its periphery, is placed inside cylinder 7". The threads around the top of pipe 7' are covered with tape (not shown) to protect them while the concrete is poured.

The gap 21 between cylinder 7" and cylinder 16 is filled with aggregate (small pebbles) and the cylinder 16 is filled with concrete. Next the cylinder 16 is pulled out, allowing integration of the concrete and aggregate. After the concrete is set, the outer cylinder 7" is removed leaving an exposed aggregate post.

Figure 5:
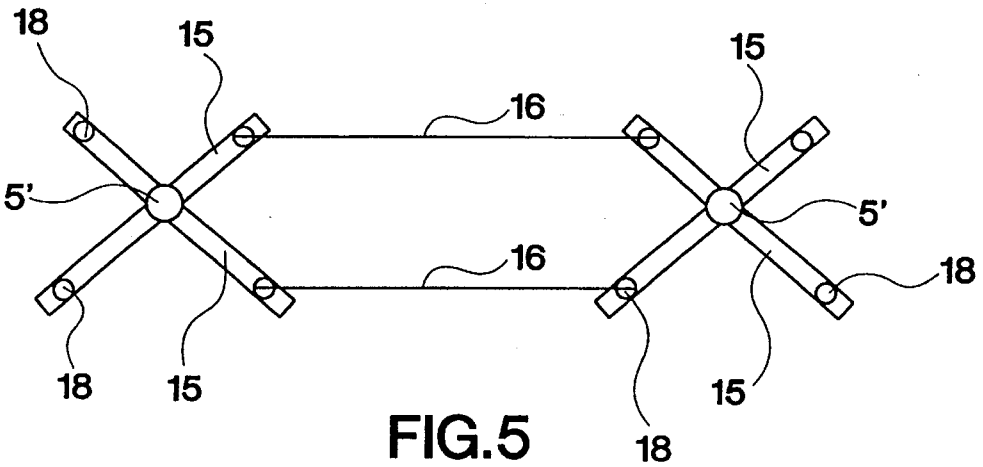
FIG. 5 is a top view of the jig being used to form a wall.
Figure 6:
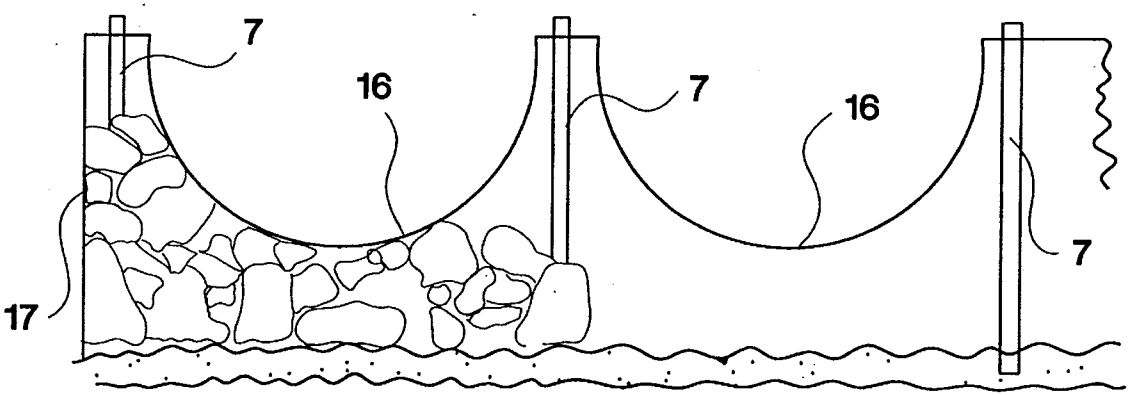
FIG. 6 is a side view of a partially finished wall.

In FIG. 5, a schematic shows the upper collar 5' used with a sweep 16 to build a stone wall. The sweeps 16 are made from aluminum conduit which can be bent to any shape. Each of the sweeps is attached to the threaded collar 5' by bolts (not shown) through the holes 18 or they can be attached to the legs 10' by any conventional means. The conduit 16 can be bent as shown in FIG. 6 to act as a guide for the stone work 17. Although only three stone posts are shown in FIG. 6, it should be understood that any number of stone post can be used by adding more collars 5' and sweeps 16.

In using the post guide system, the jig 1 is placed at the desired location and is leveled by driving the legs 10 into the ground. A level can be used on the top of the bottom collar and the top of the top collar or centering collar to ensure that the jig is level. Stones are laid using the jig legs as a guide to level and plumb the stones.

In the FIG. 4 embodiment the aggregate and concrete are poured, as pointed out above, and the cylinder 16 is removed to form an exposed aggregate post, as explained above.

Although the stone guide post and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A stone post guide system comprising:

a jig having at least two pair of legs, a first collar attached adjacent to one end of said legs, a second collar attached adjacent to another end of said legs, a third collar which slips over said first collar, said legs are attached to said first collar and extending downward to and past said second collar, a pipe having external threads on one end, a cylinder open at both ends, and having no threads, said cylinder being attached in the center of said third collar, and having at least a portion of said pipe protrude through said cylinder, L-shaped bars attached to an external surface of said pipe, whereby said legs may be driven into the ground to level said stone post guide system, and said legs may be used as a guide for laying stone to form a stone post.

2. The stone post guide system as claimed in claim 1 wherein, said collars are continuous.

3. The stone post guide system as claimed in claim 1 wherein, at least one of said collars has a pair of splits and has means for holding the collar together at the splits.

4. The stone post guide system as claimed in claim 1 wherein, said legs, said pipe and said L-shaped bars are embedded in concrete.

5. The stone post guide system as claimed in claim 1 wherein, said first collar is internally threaded and has a pair of bars in the shape of an X attached thereto.

6. The stone post guide system as claimed in claim 5 wherein, at least a pair of collars with internal threads are connected together by at least a pair bendable elements, whereby at least a pair of stone post guides can be connected together to form a guide for erecting a wall.

7. The stone post guide system as claimed in claim 1 wherein, said pipe has a second cylinder mounted coaxial therewith forming a first cavity between said pipe and said second cylinder, said second cylinder has protrusions on an external surface, a third cylinder mounted coaxial with said second cylinder, said protrusions engaging an internal surface of said third cylinder to form a second cavity, whereby concrete may be placed in said first cavity and aggregate may be placed in said second cavity and when said second cylinder is removed, said concrete and aggregate will mix forming an aggregate post.

* * * * *